US007142080B2

(12) United States Patent
Fujiyama

(10) Patent No.: US 7,142,080 B2
(45) Date of Patent: Nov. 28, 2006

(54) STICK-TYPE IGNITION COIL AND TERMINAL ASSEMBLY THEREFOR

(75) Inventor: Norihito Fujiyama, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/047,673

(22) Filed: Feb. 2, 2005

(65) Prior Publication Data

US 2005/0174206 A1 Aug. 11, 2005

(30) Foreign Application Priority Data

Feb. 9, 2004 (JP) ..... 2004-032134

(51) Int. Cl.
*H01F 27/02* (2006.01)

(52) U.S. Cl. ..... 336/92; 336/90; 336/96

(58) Field of Classification Search ..... 336/92
See application file for complete search history.

(56) References Cited

U.S. PATENT DOCUMENTS 4,653,460 A * 3/1987 Ooyabu et al. ..... 123/645
5,008,643 A * 4/1991 Heritier-Best ..... 336/96
5,622,157 A 4/1997 Murata ..... 123/647
6,032,658 A 3/2000 Miwa et al. ..... 123/655
6,095,125 A 8/2000 Miwa et al. ..... 123/655
6,343,595 B1 * 2/2002 Nakabayashi et al. ..... 123/634
6,559,747 B1 * 5/2003 Shimoide et al. ..... 336/96

FOREIGN PATENT DOCUMENTS

JP 9-317616 12/1997

* cited by examiner

*Primary Examiner*—Anh Mai
*Assistant Examiner*—Joselito Baisa
(74) *Attorney, Agent, or Firm*—Nixon & Vanderhye PC

(57) ABSTRACT

A stick-type ignition coil comprises a coil part, an insulating ring-shaped terminal assembly and a control part. The coil part includes a central core, a primary coil and a secondary coil. The terminal assembly is press-fitted on the upper end part of a primary spool of the primary coil. The terminal assembly has a primary terminal for holding a pair of ends of the primary winding of the primary coil, and an on-voltage suppressing diode connected between the primary and the secondary windings. The control part includes an insulating upper case press-fitted on the terminal assembly and an igniter disposed in the upper case.

14 Claims, 2 Drawing Sheets

STICK-TYPE IGNITION COIL AND TERMINAL ASSEMBLY THEREFOR

CROSS REFERENCE TO RELATED APPLICATION

This application is based on and incorporates herein by reference Japanese Patent Application No. 2004-32134 filed on Feb. 9, 2004.

FIELD OF THE INVENTION

The present invention relates to a stick-type ignition coil, which applies high voltages to spark plugs for an internal combustion engine, and a terminal assembly for such an ignition coil.

BACKGROUND OF THE INVENTION

A stick-type ignition coil has a coil part provided in the middle part in the axial direction, a control part provided at its one end (upper end part) and a tower part at its other end (lower end part). In the coil part, a central core, a primary coil, a secondary coil and the like are accommodated within a cylindrical coil case. In the control part, an electronic control circuit (igniter) is accommodated within a box-shaped upper case. The coil case and the upper case are coupled to each other after being molded separately. The igniter causes the secondary coil to generate a high voltage by interrupting a current, which flows in the primary coil.

It is required to suppress an on-voltage to accurately control an ignition time point by the ignition coil. The on-voltage means a voltage, which arises in the secondary coil in the opposite direction to a predetermined voltage when the supply of current to the primary coil changes from the truned-off condition to the turned-off condition. This on-voltage arises at time points other than the ignition time points (primary current turn-off time points). Therefore, an engine will not operate normally when a spark plug generates sparks in response to this on-voltage.

It is possible to restrict the adverse effects due to the on-voltage by suppressing the voltage level of the on-voltage to be less than a voltage with which a spark plug generates sparks. In the conventional ignition coil (U.S. Pat. No. 6,095,125, U.S. Pat. No. 6,032,658 and JP10-176647A), for instance, as shown in FIG. 5, a battery voltage is applied to one end 81 of a primary coil 80 and a switching power transistor 82 is connected to its other end. A Zener diode 85 is connected between the primary coil 80 and a low voltage side of a secondary coil 84 connected to a spark plug 87 in such a manner that the on-voltage becomes a reverse voltage. The Zener diode 85 and a power transistor 82 are mounted on a circuit board of an igniter of a control part.

The diametrical dimension of the control part of this conventional ignition coil is large and hence the head part of this coil is expanded. Specifically, as the power transistor and the Zener diode are normally arranged on the circuit board of the igniter, the transverse area (planar area viewed as a plane) becomes large. Thus, the size of the igniter affects the size of the upper case, that is, control part.

The outer diameter of the coil part is required to be reduced to cope with the reduction of inner diameters of the plug holes in an engine head. It becomes difficult, however, to reduce the volume and diameter of the coil head part, because the size of the igniter affects the dimension of the coil head part. Thus, the reduction in volume and diameter of the coil part is limited in the conventional ignition coil, in which the on-voltage suppressing Zener diode is mounted on the circuit board of the igniter.

SUMMARY OF THE INVENTION

It is an object of the present invention to provide a stick-type ignition coil, which includes an on-voltage suppressing diode and has a small-sized coil head part and a reduced-diameter coil body part, and to provide a terminal assembly for the stick-shaped ignition coil.

An ignition coil according to the present invention comprises at least a coil part and a control part. The coil part includes a central core, a primary and a secondary coil provided radially outside the central core, a thin film sheet provided radially outside the radially outside one of the spools and the like. The control part includes a circuit case, an igniter, terminals and the like, which are accommodated within the circuit case.

The igniter interrupts a current flowing in the primary coil so that the secondary coil responsively generates a high voltage. In the primary coil, a primary winding is wound on an insulating and cylindrical primary spool. In the secondary coil, similarly, a secondary winding is wound on an insulating and cylindrical secondary spool. In the radial direction of the ignition coil, the secondary coil may be provided inside and the primary coil may be provided outside. Oppositely, the primary coil may be provided inside and the secondary coil may be provided outside. A secondary terminal attached to the secondary spool an extension part, which holds one end of the secondary winding, extends on an upper end part surface and is connected to a diode.

A terminal assembly is generally cylindrical or ring-shaped and has a certain length in the axial direction. The inside peripheral surface of the terminal assembly has a shape and dimension, which are suitable for being press-fitted to the outside spool. The outside peripheral surface of the terminal assembly has a shape and dimension, which are suitable for being press-fitted in the upper case. The outer diameter of the outside peripheral surface and the inner diameter of the inner peripheral surface of the terminal assembly may be the same or partly different over the entire axial length. The terminal assembly has at least a first ring-shaped part at its lower end side and a second ring-shaped part at its upper end side. The first ring-shaped part is press-fitted to the upper end part of the spool (outside spool) provided at the radially outer side, and the second ring-shaped part is for mounting the terminals and the diode thereon.

The terminal assembly has three functions.

The first function is to assist coupling of the outside spool of the coil part and the upper case of the control part. For this purpose, the inside peripheral surface of the first ring-shaped part is press-fitted to the outside peripheral surface of the upper end part of the outside spool and the upper case of the control part is press-fitted to the outside peripheral surface of the terminal assembly. The terminal assembly is an intermediary part between the coil part and the control part and is also a part of the both parts.

The second function is to hold both end parts of the primary winding. For this purpose, the terminal assembly has a pair of primary terminals, which hold both end parts of the primary winding extending in the upward direction through a hollow part of the terminal assembly. Each primary terminal a fixed part fixed to the terminal assembly and a holding part for holding the end part of the primary winding. The extension part of the secondary terminal attached to the secondary spool is exposed on the upper end part surface of the second ring-shaped part. The first ring-shaped part may be press-fitted to the outside spool through the thin film sheet, and a third ring-shaped part which is provided at lower side of the first ring-shaped part may be press-fitted to the outside core.

The third function is to support the on-voltage suppressing diode. The diode has a withstanding voltage higher than the on-voltage. It is arranged between one end part (battery side) of the primary winding and the lower voltage side end part of the secondary winding in a direction to control the on-voltage (in a direction reverse to the voltage generated at the time of turn-on). The diode has a body (element) and a pair of lead wires extending from its both ends. The body is arranged in a tangential direction on the upper end part surface of the second ring-shaped part. One lead wire and the other lead wire extend arcuately toward the one of the primary terminals and the extension part of the secondary terminal, respectively. Preferably, the diode is attached on the terminal assembly in advance, and then the diode and the primary terminal are coupled and connected to each other at the same time as attaching the primary terminal to the terminal assembly.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

An embodiment of the present invention will be described below with reference to the accompanying drawings.

Figure 1:
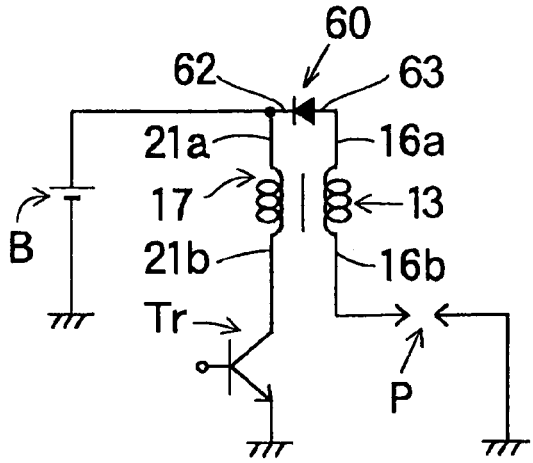
FIG. 1 is a circuit diagram of an ignition device using an ignition coil according to the present invention.

An ignition device for an internal combustion engine is shown in FIG. 1. The ignition device uses a stick-type ignition coil, which comprises a primary coil 17 and a secondary coil 13. The primary coil 17 has one end 21*a* connected to a battery voltage B and the other end 21 connected to a switching power transistor Tr. An on-voltage suppressing diode 60 is connected between the one end 21*a* of the primary coil 17 and one end (low voltage side end part) 16*a* of a secondary coil 13 in a direction that the diode 60 is biased in reverse by on-voltages. The other end (high voltage side end part) 16*b* of the secondary coil 13 is connected to a spark plug P. The diode 60 allows the secondary coil 13 to generate a high spark voltage when a current supply to the primary coil 17 is turned off by the turn-off of the transistor Tr but restricts the secondary coil 13 from generating a high voltage (on-voltage) when the current supply to the primary coil 17 is turned on by the turn-on of the transistor Tr.

Figure 2:
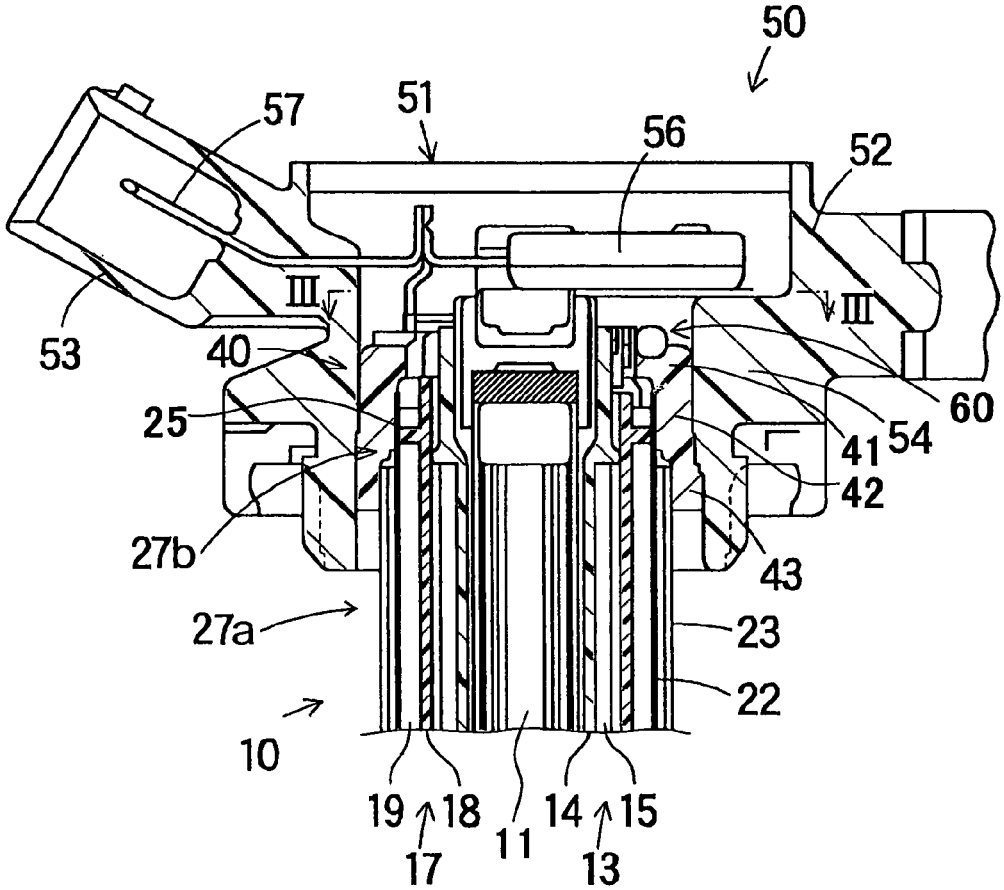
FIG. 2 is a longitudinal cross sectional view of a main part of one embodiment of the ignition coil according to the present invention.

FIG. 2 shows in detail a part of a coil part 10 and a control part 50 of the ignition coil. The control part 50 includes the transistor Tr and controls the turn-on and turn-off of the power transistor Tr. The coil part 10 is in the middle part in the axial direction and inserted in a plug hole (not shown) of an engine head. The control part 50 provided at the upper end part is seated on the upper surface of an engine heat cover. The coil part 10 and the control part 50 are coupled to each other through a terminal assembly 40, which is an indulating ring-shaped case.

In the coil part 10, a central core 11, a secondary core 13, a primary core 17, a thin film sheet 22 and an outside core 23 are disposed from the center toward the radially outside peripheral part. The secondary coil 13 includes an insulating tubular secondary spool 14 and a secondary winding 15 wound on the outside peripheral surface of the spool 14. The primary coil 17 includes an insulating tubular primary spool 18 and a primary winding 19 wound on the outside peripheral surface of the spool 18. A conductive secondary terminal 48 (FIG. 3) is attached to the upper end part of the secondary spool 14 located at the radially inner side. This terminal 48 is shown at the right side in FIG. 3 and holds one end 16*a* of the secondary winding 15. A flange part 25 is formed at the upper end part of the primary spool 18 located at the radially outer side.

A tubular thin film sheet 22 covers the primary winding 19. Its upper end part extends beyond the flange part 25 and reaches the upper end part of the primary spool 18. A tubular thin outer core 23 is disposed radially outside the thin sheet 22 at a part facing the primary winding 19. The thin sheet 22 is insulative and shaped in a tube in correspondence to the shape of the primary spool 18 in the assembled condition. Its thickness is preferably from 0.1 mm to 0.3 mm. It may be disposed radially outside or inside the primary spool 18. Other tubes such as a constrictive tube may be used in place of the thin sheet 22. The outer diameter of the coil part 10 measured from the central core 11 to the outer core 23 is from about 17 mm to 19.9 mm. In the coil part 10, the upper end part of the primary spool 18 forms a coil head part 27*b* and the other part of the same forms a coil body part 27*a*.

Figure 3:
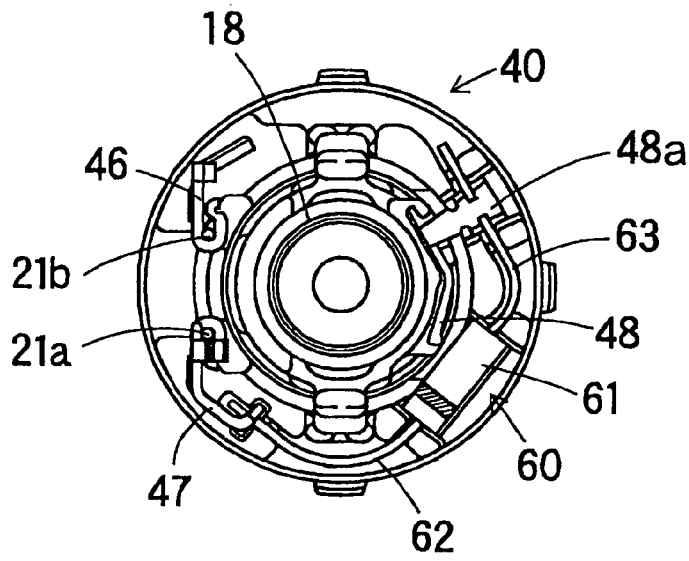
FIG. 3 is a sectional view taken along line 3—3 in FIG. 2.
Figure 4:
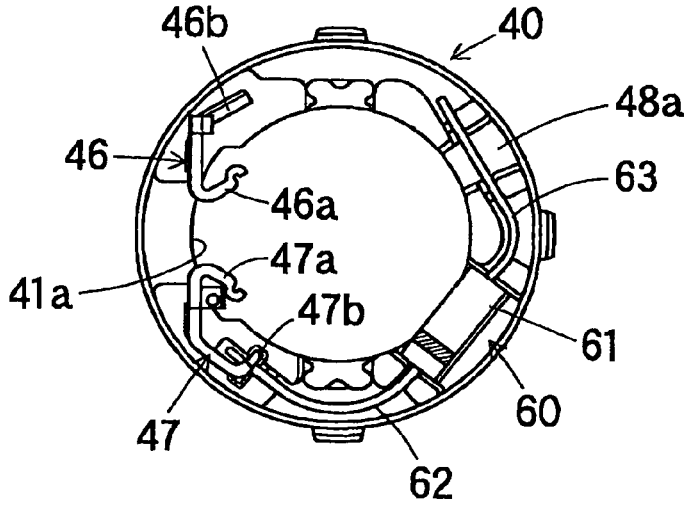
FIG. 4 is a sectional view showing a state in which only a terminal assembly is assembled in FIG. 3.
Figure 5:
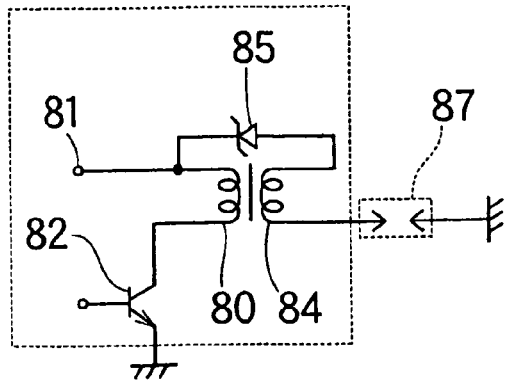
FIG. 5 PRIOR ART
FIG. 5 is a circuit diagram of a conventional ignition device.

As shown in FIGS. 2 to 4, the terminal assembly 40 is insulative and ring-shaped with an upper part 41, an intermediate part 42 and a lower end part 43. The upper end part 41 is the smallest in both outer diameter and inner diameter. The lower end part 43 is the largest in both outer diameter and inner diameter. The outer diameter and the inner diameter of the intermediate part 42 are between the outer diameters and the inner diameters of the two end parts, respectively.

As understood from FIG. 4, the upper end part 41 has a recess 41*a* at its radial inside. The inner diameter of the intermediate part 42 is generally equal to the outer diameter of the flange part 25. The inner diameter of the lower end part 43 corresponds to the outer diameter of the outer core 23. The outer diameters of the intermediate part 42 and the lower end part 43 are generally equal to the inner diameter of a connecting part 54 of the upper case 51. The inner diameter of the upper part 41 is less than 23 mm, and preferably less than 19 mm.

One end 21*a* and the other end 21*b* of the primary winding 19 extend to the upper end part surface passing through the flange part 25 of the primary spool 18 and the recess 41*a* of the upper end part 41 of the terminal assembly 40. An extension part 48*a* of the secondary terminal 48 passes the hollow part of the upper end part 41 and is exposed on the upper end part surface.

Further, the terminal assembly 40 has a pair of conductive primary terminals 46 and 47. Those are shown in the left side in FIG. 3. One primary terminal 46 has a U-shaped part 46*a* and a fixing part 46*b*. The part 46*a* holds the other end 21*b* of the primary winding 19 and the part 46*b* is fixed to the terminal assembly 40. The other primary terminal 47 has a U-shaped part 47*a* and a fixing part 47*b*. The part 47*a* holds one end 21*a* of the primary winding 19 and the part 47*b* is fixed to the terminal assembly 40.

On the upper end part surface of the terminal assembly 40, the diode 60 is mounted. The diode 60 has a body 61 and a pair of lead wires 62 and 63 extending from the end part surfaces of the body 61. The body 61 is disposed between the other primary terminal 47 and the extension part 48*a* of the secondary terminal 48 in the tangential direction of the terminal assembly 40. One lead wire 62 extends arcuately in the clockwise direction, and is connected to the fixing part 47*b* of the primary terminal 47 and the one end 21*a* of the primary winding 19. The other lead wire 63 extends arcuately in the counter-clockwise direction, and is held by the extension part 48*a* of the secondary terminal 48 and connected to the one end 16*a* of the secondary winding 15. As understood from FIG. 2, the diode 60 is placed underside an igniter 56 such that it is hidden below the igniter 56 when viewed from the top of the ignition coil. More specifically, the diode 60 is disposed inside the outer periphery of the igniter 56 in the radial direction.

Insulating resin (not shown) is filled in spaces between the secondary winding 15 and the primary spool 18 and between the primary winding 19 and the thin film sheet 22 and the like. The intermediate part 42 of the terminal assembly tightly adheres to the radially outside surface of the thin film sheet 22, which extends up to the upper end part of the primary spool 18, thus sealing the space between the primary winding 19 and the thin film sheet 22.

As understood from FIG. 2, the circuit case 61 of the control part 50 has a box-shaped accommodation part 52, a connector part 53 and a coupling part 54. The igniter 56 including the power transistor Tr is disposed in the accommodation part 51. The connector part 53 extends from the accommodation part 52 and includes a terminal 57 to which the igniter 56 and the primary winding 19 are connected. Insulating resin (not shown) is also filled in the accommodation part 52 and around the igniter 56. The coupling part 54 extending from the bottom surface of the accommodation part 52 has a ring shape and has its inner diameter, which is generally equal to the outer diameter of the upper end part 41 of the terminal assembly 40. The coupling part 54 is press-fitted to the radially outside peripheral surface of the terminal assembly 40, which is also press-fitted to the radially outside peripheral surface of the primary spool 18. Thus, the control part 50 is firmly coupled with the coil part 10.

The above stick-type ignition coil is assembled in the following manner. The coil part 10 and the control part 50 are assembled separately from each other. Then the control part 50 is assembled to the coil part 10 by using the terminal assembly 40. The terminal assembly 40 is press-fitted to an integral unit of the thin film sheet 22 and the outer core 23 fitted on the outside of the primary coil 17. As shown in FIG. 4, the diode 60 is mounted on the terminal assembly 40 in advance. The lead wire 62 is press-fitted to the fixing part 47*b* when the primary terminals 46 and 47 are attached.

The lower end part 43 of the terminal assembly 40 is press-fitted to the outside surface of the outer core 23, and the intermediate part 42 is press-fitted to the outside surface of the thin film sheet 22, which covers the flange part 25 of the primary spool 18. As a result, the space between the primary spool 18 and the thin film sheet 22 is sealed by the terminal assembly 40. Here, one end 21*a* and the other end 21*b* of the primary winding 19 are extended upward. Therefore, those ends 21*a* and 21*b* are inserted and held in the holding part 47*a* and 46*a* of the primary terminals 47 and 46, when the terminal assembly 40 is press-fitted to the primary spool 18.

Next, the secondary coil 13 is inserted into the inner side of the primary coil 17 and the central core 11 is inserted into the inner side of the secondary coil 13. At this moment, the extension part 48*a* of the secondary terminal 48 attached to the secondary spool 14 is connected to the other lead wire 63 of the diode 60 mounted on the terminal assembly 40.

Then, the coupling part 54 of the upper case 51 is press-fitted to the outside surface of the upper end part 41. That is, the control part 50, in which the igniter 56 and the terminal 57 are disposed in position in the circuit case 51, is coupled to the coil part 10. The other end 21*b* of the primary winding 19 is connected to the igniter 56 and the terminal 57 in the control part 50 through the primary terminal 46. The spaces between the secondary winding 15 and the primary spool 18 and between the primary winding 19 and the thin film sheet 22 and the like filled with resin by filling molten resin in spaces in the upper case 51.

The above embodiment has the following advantages. The diode between the primary winding 19 and the secondary winding 15 suppresses the on-voltage. As a result, ignition time points can be controlled accurately and the engine can operate stably. The connection between the lead wire 62 and the primary terminal 47 and the connection between the lead wire 63 and the extension part 48*a* of the secondary terminal 48 can be made easily and simply.

The outer diameter of the coil part 10 can be reduced from various points. First, the outer layer of the coil part 10 is provided by the thin film sheet 22 disposed at the coil body part 27*a*. The thickness of the thin film sheet 22 is between about one half and one third of the conventional coil case. This film sheet 22 therefore is very effective to reduce the diameter of the coil part 10.

The upper case 51, that is, the radial dimension of the coil head part 27*b* is reduced. The dimension of the igniter substantially determines the radial dimension of the upper case 51. As the on-voltage suppressing diode 60 is mounted on the terminal assembly 40 separate from the igniter 56, the igniter 56 does not require a mounting space for the diode. Thus, the upper case 51 and the coil head part 27*b* can be reduced in the radial direction correspondingly. Although dependent on various conditions, the transverse area of the coil part 10 can be reduced about 35% from the conventional coil size, and the entire weight of the ignition coil can be reduced about 30% from the conventional coil weight.

The primary terminals 46 and 47, the extension part of the secondary terminal 48 and the diode 60 are mounted on the upper end part surface of the upper end part 41 of the terminal assembly 40. Therefore, the outer diameter of the terminal assembly 40 need not be enlarged even if the primary terminals 46 and the like are provided on the terminal assembly 40.

The coil part 10 and the control part 50 can be firmly coupled. This is because the terminal assembly 40 is press-fitted to the upper end part of the primary spool 18 disposed at the radially outer side in the coil part 10 and the upper case 51 is press-fitted to the terminal assembly 40. With the primary spool 18 and the upper case 51 are coupled firmly, insufficient coupling between the coil part 10 and the control part 50 will not arise even if the thin film sheet 22 is used at the radial outside of the coil part 10. The terminal assembly 40 is positioned between the upper case 51 and the thin film sheet 22 covering the primary spool 18, and the spaces between the primary spool 18 and the thin film sheet 22 and between the primary spool 18 and the upper case 51 are sealed so that epoxy resin will not leak.

As described above, the terminal assembly 40 is advantageous in reducing the diameter of the coil part 10, coupling the coil part 10 and the control part 50, providing mounting spaces for the terminals 46 to 48 and the diode 60, sealing between the primary spool 18 and the thin film sheet 22, and the like.

What is claimed is:

1. A stick-type ignition coil comprising:

a coil part including a central core, a primary coil and a secondary coil disposed radially outside the central core and a secondary terminal, the primary coil having a primary spool and a primary winding wound about the primary spool, the secondary coil having a secondary spool and a secondary winding wound about the secondary spool, the secondary terminal being attached to the secondary spool and holding one end of the secondary winding;

an insulating, ring-shaped terminal assembly press-fitted to a radially outside part of an upper end part of an outside spool, which is the one of the primary and the secondary spools that is provided more radially outside than the other, the terminal assembly including primary terminals holding ends of the primary winding of the primary coil; and a control part press-fitted to the terminal assembly.

2. The stick-type ignition coil as in claim 1, wherein the terminal assembly includes an on-voltage suppressing diode connected to the primary and the secondary windings.

3. The stick-type ignition coil as in claim 2, wherein the control part includes:

an insulating upper case press-fitted to the terminal assembly; and an igniter disposed within the upper case.

4. The stick-type ignition coil as in claim 3, wherein the terminal assembly includes:

a first ring-shaped part press-fitted to the outside spool; and a second ring-shaped part having mounted thereon the primary terminals and the diode.

5. The stick-type ignition coil as in claim 4, wherein: the primary terminals and the diode are fixed on a surface of the second ring-shaped part; and the secondary terminal has an extension part extending on the surface of the second ring-shaped part.

6. The stick-type ignition coil as in claim 5, wherein the diode is disposed radially inside an outer periphery of the igniter.

7. The stick-type ignition coil as in claim 4, wherein:

the coil part includes a thin film sheet covering the outside spool; and the first ring-shaped part of the terminal assembly is press-fitted to the outside spool through the thin film sheet.

8. A terminal assembly of a stick-type ignition coil for coupling a coil part and a control part, the coil part including a central core, a primary coil with a primary winding and a secondary coil with a secondary winding and a secondary terminal, and the control part including an igniter, the terminal assembly comprising:

a first ring-shaped part press-fitted to an upper end part of a spool of an outside coil, which is one of the primary coil and the secondary coil disposed more outside than the other; and a second ring-shaped part including a pair of primary terminals connected to a pair of end parts of the primary winding, and an on-voltage suppressing diode connecting the primary winding and the secondary winding, wherein one primary terminal has one holding part, which is fixed to an upper end part surface of the second ring-shaped part and holds one end part of the primary winding, and the other primary terminal has the other holding part, which is fixed to the upper end part surface of the second ring-shaped part and holds the other end part of the primary winding, wherein the secondary terminal holds one end of the secondary winding and has an extension part, which extends on an upper end part surface of the second ring-shaped part, and wherein the diode has a pair of lead wires, one of which is connected to the other holding part of the primary terminal and the other of which is connected to the extension part of the secondary terminal.

9. The terminal assembly as in claim 8, wherein:

the primary terminals are located close to each other on the upper end part surface of the second ring-shaped part;

the extension part of the secondary terminal is located away and on an opposite side from the primary terminals in a radial direction; and the diode is disposed between the other primary terminal and the extension part of the secondary terminal.

10. The terminal assembly as in claim 9, wherein the first ring-shaped part has an inner diameter, which is less than 23 mm.

11. A stick-type ignition coil comprising:

a coil part including a central core and a primary coil and a secondary coil disposed radially outside the central core, the primary coil having a primary spool and a primary winding wound about the primary spool, the secondary coil having a secondary spool and a secondary winding wound about the secondary spool; and an insulating, ring-shaped terminal assembly press-fitted to a radially outside part of an upper end part of the primary spool and including primary terminals holding ends of the primary winding of the primary coil.

12. The stick-type ignition coil as in claim 11, further comprising:

a connector press-fitted to the terminal assembly for connecting the primary winding to an external power source.

13. A stick-type ignition coil comprising:

a coil part including a central core, a primary winding and a secondary windings, the windings disposed radially outside the central core;

an insulating ring-shaped terminal assembly press-fitted to one axial end part of the coil part and including an on-voltage suppressing diode connected to the primary winding and the secondary winding; and a control part press-fitted to the terminal assembly and including an igniter for controlling a supply of power to the primary winding, wherein the diode is located radially inside an outer periphery of the igniter and separately from the igniter in an axial direction of the coil part.

14. A stick-type ignition coil comprising:

a coil part including a central core, a primary coil and a secondary coil disposed radially outside the central core and a secondary terminal, the primary coil having a primary spool and a primary winding wound about the primary spool, the secondary coil having a secondary spool and a secondary winding wound about the secondary spool, the secondary terminal being attached to the secondary spool and holding one end of the secondary winding; and an insulating, ring-shaped terminal assembly press-fitted to an upper end part of an outside spool, which is the one of the primary and the secondary spools that is provided more radially outside than the other, the terminal assembly including primary terminals holding ends of the primary winding of the primary coil, wherein the terminal assembly includes:

an on-voltage suppressing diode connected to the primary and the secondary windings, a first ring-shaped part press-fitted to the outside spool; and a second ring-shaped part having mounted thereon the primary terminals and the diode.

* * * * *